US011884475B2

(12) United States Patent
Ramsuer

(10) Patent No.: US 11,884,475 B2
(45) Date of Patent: Jan. 30, 2024

(54) AEROSOL ACTUATORS AND METHODS FOR USING THE SAME

(71) Applicant: SILGAN DISPENSING SYSTEMS CORPORATION, Richmond, VA (US)

(72) Inventor: Brandon Ramsuer, Henrico, VA (US)

(73) Assignee: SILGAN DISPENSING SYSTEMS CORPORATION, Grandview, MO (US)

( * ) Notice: Subject to any disclaimer, the term of this patent is extended or adjusted under 35 U.S.C. 154(b) by 0 days.

(21) Appl. No.: 17/300,315

(22) Filed: Aug. 18, 2021

(65) Prior Publication Data

US 2023/0053782 A1 Feb. 23, 2023

(51) Int. Cl.
*B65D 83/20* (2006.01)

(52) U.S. Cl.
CPC ..... *B65D 83/205* (2013.01)

(58) Field of Classification Search
CPC ..... B65D 83/205
See application file for complete search history.

(56) References Cited

U.S. PATENT DOCUMENTS

| | | | | |
|---|---|---|---|---|
| 7,588,171 | B2 * | 9/2009 | Reedy | B65D 83/22 222/402.11 |
| 8,201,710 | B2 * | 6/2012 | Helf | B65D 83/206 222/153.09 |
| 8,276,832 | B2 * | 10/2012 | Nelson | B05B 1/1645 239/394 |
| 9,061,817 | B2 * | 6/2015 | Lind | B65D 83/206 |
| 9,862,535 | B2 * | 1/2018 | Christianson | B65D 83/205 |
| 11,708,210 | B2 * | 7/2023 | Spang, Jr. | B65D 83/206 222/402.13 |
| 2013/0037581 | A1 * | 2/2013 | Andersen | B65D 83/206 29/428 |
| 2016/0236854 | A1 * | 8/2016 | Soliman | B65D 81/2053 |
| 2017/0233171 | A1 * | 8/2017 | Christianson | B65D 83/205 222/402.13 |
| 2017/0247173 | A1 * | 8/2017 | Jack | B65D 83/285 |

* cited by examiner

*Primary Examiner* — Frederick C Nicolas

(57) ABSTRACT

An aerosol dispensing system having an aerosol actuator with a skirt and a skirt angle of between 50 and 70 degrees fitted on an aerosol can having a can slope angle within about 3 or 5 or 7 or 10 degrees of the skirt angle.

9 Claims, 3 Drawing Sheets

AEROSOL ACTUATORS AND METHODS FOR USING THE SAME

BACKGROUND OF THE INVENTION

Field of the Invention

Embodiments of the invention relate to aerosol actuators and more particularly to aerosol actuators that may be applied to multiple different shaped aerosol cans.

Description of Related Art

Aerosol actuators are well known and many different types and varieties are available to producers and consumers. For example, push button actuators, spray through actuators, trigger actuators and other actuators have been developed to dispense products from aerosol cans.

With the advent of new aerosol bottle technologies allowing more appealing graphics, design, and production costs, many producers of aerosol packaging are moving to the so-called two-piece aerosol can designs. Producers are also moving towards the use of plastic aerosol containers.

One of the benefits associated with the two-piece aerosol containers and the plastic aerosol containers are the expanded range of shapes and sizes that may be made and offered to brands. However, because many aerosol actuators—and especially those with unique aesthetics—are made to fit a particular can size, custom actuators are required. This leads to additional costs to create multiple sizes of a similar actuators for a brand. In addition, because different brands have different sizes of cans, aerosol actuators made for one brand may not fit on containers for other brands or other sizes in the same brand.

It is therefore desirable to be able to produce an aerosol actuator that may be used on a number of different aerosol can or plastic aerosol bottle sizes. It is also desirable to be able to produce an aerosol actuator that can be used across multiple bottle sizes to help brand owners create a consistent look across their product lines or product sizes.

BRIEF SUMMARY OF THE INVENTION

Aerosol actuators according to various embodiments of the invention are configured to snap or otherwise connect to a valve cup and especially valve cups commonly used with two-piece cans. In various embodiments, an aerosol actuator is configured to fit on a standard one inch valve cup commonly used with tailored two-piece aerosol cans or plastic aerosol containers. The dimensions of the aerosol actuator according to embodiments of the invention include a sloped skirt having angles to create an impression that the skirt of the aerosol actuator is integrated with the aerosol can or plastic aerosol container. In some embodiments, the tangency angle of the aerosol actuator may be up to +/−10 degrees. In other embodiments, the tangency angle of the aerosol actuator may be up to +/−20 degrees.

Aerosol actuators according to various embodiments of the invention include skirts having angles that allow the aerosol actuator to be applied to aerosol cans and plastic aerosol containers having different sizes and neck finishes.

BRIEF DESCRIPTION OF THE SEVERAL VIEWS OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
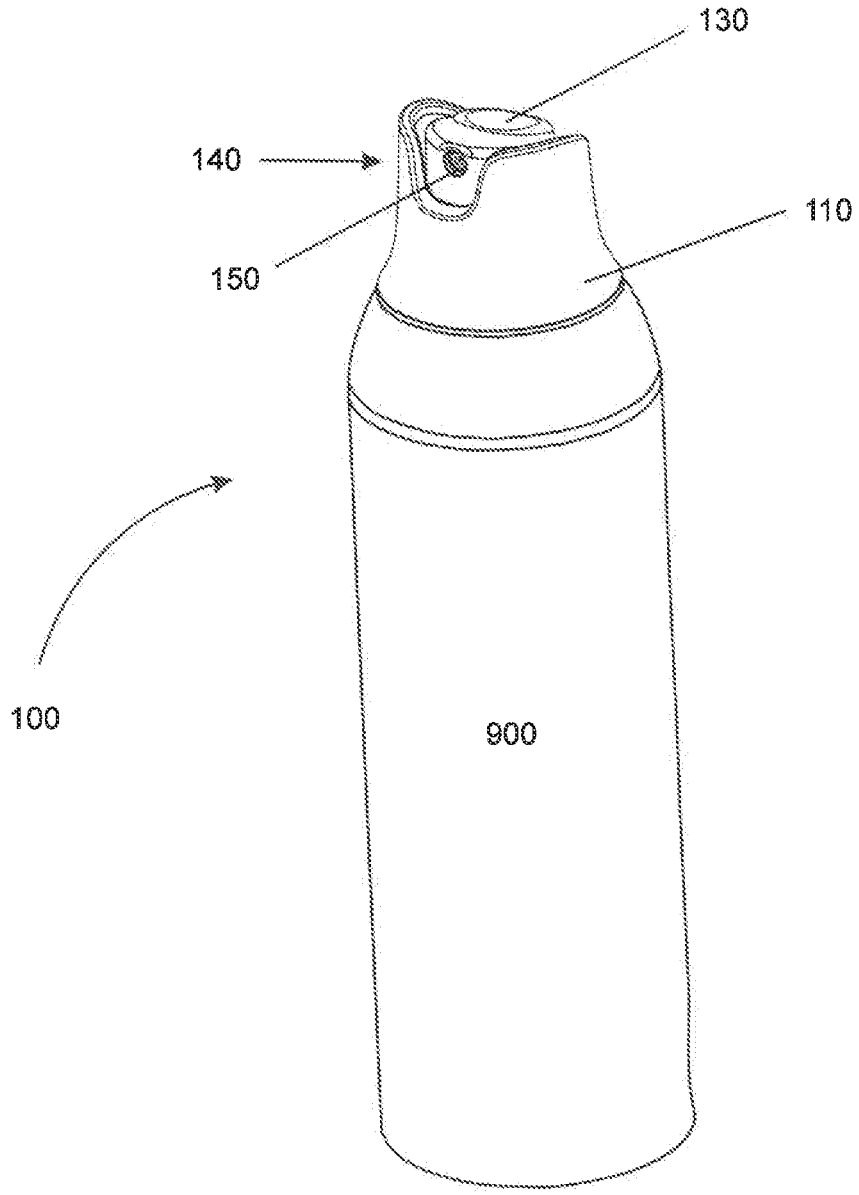
FIG. 1 illustrates an aerosol actuator on an aerosol can or plastic aerosol container according to certain embodiments of the invention.

According to certain embodiments of the invention, an aerosol actuator 100 may be attached to an aerosol can 900 or plastic aerosol container as illustrated in FIG. 1, creating an aerosol dispensing device. While various embodiments of the invention are described with respect to attachment to an aerosol can, such as a two-piece aluminum aerosol can, it is understood that the various embodiments of the invention may also be attached to plastic, steel, or other metal or polymer aerosol containers configured or shaped like conventional two-piece aerosol cans.

Aerosol actuators 100 according to various embodiments of the invention include a skirt 110 as illustrated. The aerosol actuators 100 may also include other features or components such as a manifold 120 configured to connect to an aerosol valve attached to the aerosol can 900, an actuation button 130 or surface configured to open the aerosol valve, a discharge orifice 140 and an orifice cup 150 inserted in the discharge orifice 140. The orifice cup 150 may include features and geometries to create spin mechanics applied to fluid exiting the discharge orifice 140 and apply or create a spray pattern for the delivery of the product from the aerosol actuator 100.

Figure 2:
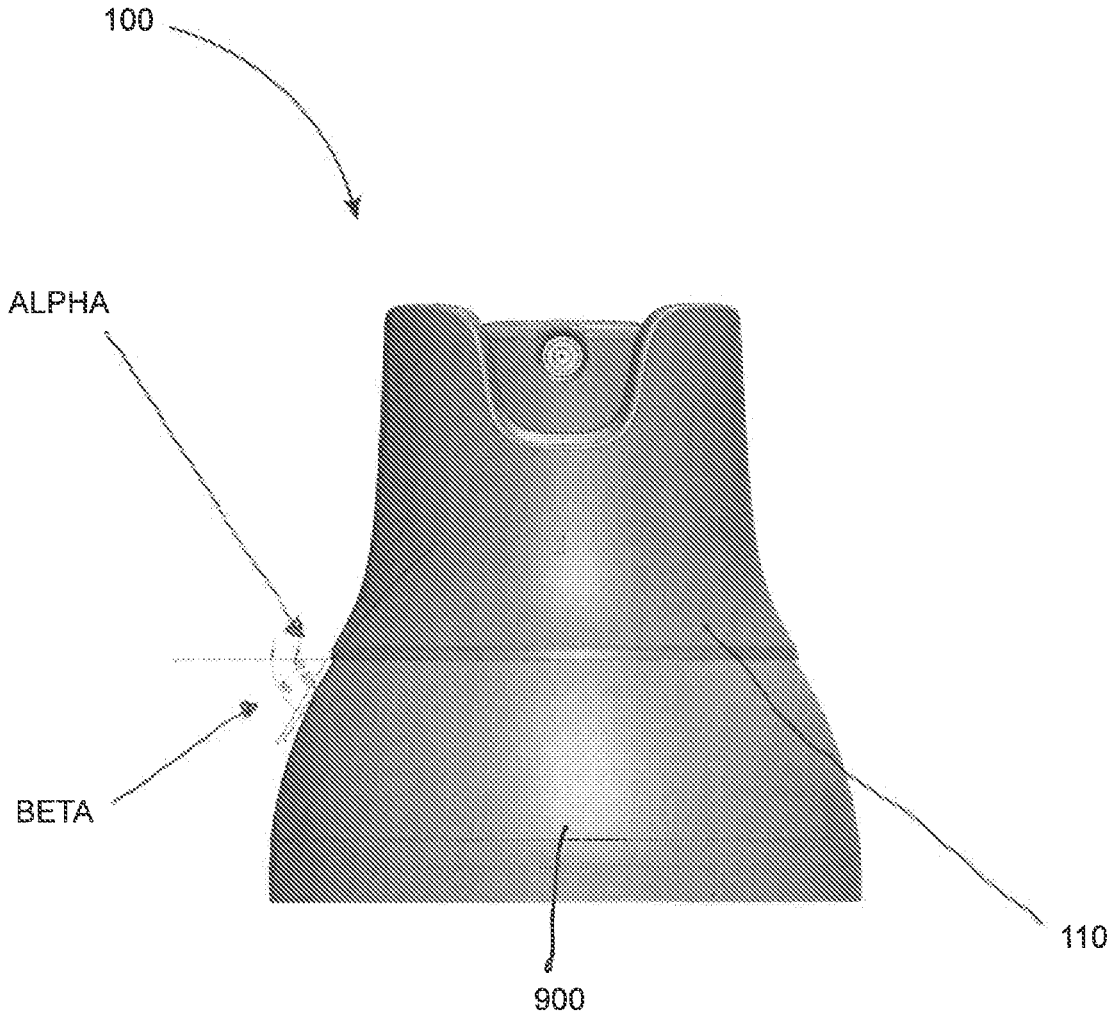
FIG. 2 illustrates an aerosol actuator on a narrow aerosol can or plastic aerosol container.
Figure 3:
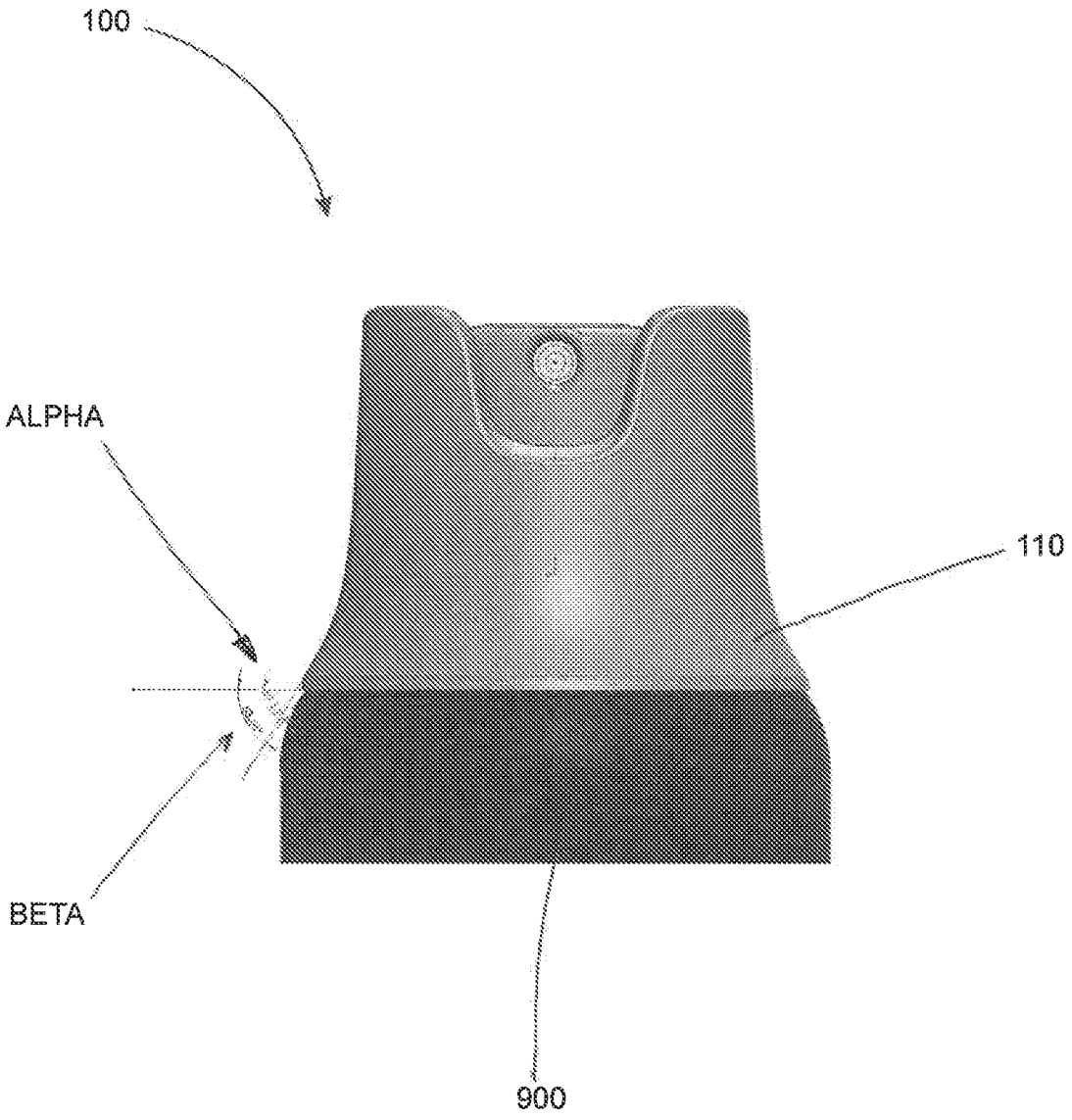
FIG. 3 illustrates an aerosol actuator on wider aerosol can or plastic aerosol container.

A skirt 110 according to various embodiments of the invention includes a skirt angle ALPHA of 59.53 degrees as illustrated in FIG. 2. The angle of the aerosol can 900 upper slope BETA is 58 degrees. The same aerosol actuator 100 is shown on a larger aerosol can 900 in FIG. 3. As illustrated, the angle ALPHA is the same at 59.53 degrees. The angle of the aerosol can 900 upper slope BETA, however, is 53.66 degrees. Even though the aerosol can 900 upper slope BETA is different between the two aerosol cans 900, the skirt angle ALPHA of the skirt 110 creates the appearance that the aerosol cans 900 are similar or that the size of the aerosol actuator 100 is different and configured to be custom to the aerosol can 900, which is it not. This appearance is advantageous because the same aerosol actuator 100 may be used on different sized aerosol cans 900, providing a consistent look and aesthetic appearance across multiple aerosol can 900 sizes.

It has been found that keeping or producing a skirt 110 of an aerosol actuator 100 with a skirt angle ALPHA between about 58 degrees and 60 degrees creates a desirable aesthetic look when used with various sizes of aerosol cans 900.

According to other embodiments of the invention, the skirt angle ALPHA may be within at least five degrees of the aerosol can 900 upper slope BETA. In other embodiments, the skirt angle ALPHA may be within at least ten degrees of the aerosol can 900 upper slope BETA. In still other embodiments of the invention, the skirt angle ALPHA may be within one to ten degrees of the aerosol can 900 upper slope BETA.

In other embodiments of the invention, it has been found that a skirt angle ALPHA of between about 55 degrees and 65 degrees may produce desirable aesthetics when an aerosol actuator 100 according to embodiments of the invention is attached to various sized aerosol cans 900.

In still other embodiments, a skirt angle ALPHA of between about 50 and 70 degrees may produce the desired aesthetics.

An aerosol actuator 100 according to various embodiments of the invention may also include a weight bearing surface 115 combined with a skirt 110 according to embodiments of the invention. A weight bearing surface 115 may be configured on the top portion of the aerosol actuator 100 such that other products may be stacked thereon, for example, other aerosol actuators 100 during shipping.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. An aerosol actuator, comprising:

a skirt having a skirt angle between 58 and 60 degrees;

an actuation button;

a discharge orifice; and an orifice cup seated in the discharge orifice.

2. The aerosol actuator of claim 1, wherein the skirt angle is 59 degrees.

3. An aerosol dispensing device, comprising:

an aerosol can;

an aerosol actuator connected to the aerosol can, comprising:

a skirt having a skirt angle between 58 and 60 degrees;

an actuation button;

a discharge orifice; and an orifice cup seated in the discharge orifice.

4. The aerosol dispensing device of claim 3, wherein the skirt angle is 59 degrees.

5. The aerosol dispensing device of claim 3, further comprising an aerosol can angle of between 50 degrees and 60 degrees.

6. The aerosol dispensing device of claim 3, further comprising an aerosol can angle and wherein the skirt angle and the aerosol can angle are within 3 degrees of each other.

7. The aerosol dispensing device of claim 3, further comprising an aerosol can angle and wherein the skirt angle and the aerosol can angle are within 5 degrees of each other.

8. The aerosol dispensing device of claim 3, further comprising an aerosol can angle and wherein the skirt angle and the aerosol can angle are within 7 degrees of each other.

9. The aerosol dispensing device of claim 3, further comprising an aerosol can angle and wherein the skirt angle and the aerosol can angle are within 10 degrees of each other.

* * * * *